US007273326B2

(12) United States Patent
Jones

(10) Patent No.: US 7,273,326 B2
(45) Date of Patent: Sep. 25, 2007

(54) FLUID CONTAINER WITH INTEGRAL BRUSH

(76) Inventor: Garon G. Jones, 39 Bella Case La., Central Islip, NY (US) 11722

( * ) Notice: Subject to any disclaimer, the term of this patent is extended or adjusted under 35 U.S.C. 154(b) by 299 days.

(21) Appl. No.: 10/910,906

(22) Filed: Aug. 4, 2004

(65) Prior Publication Data

US 2006/0029458 A1 Feb. 9, 2006

(51) Int. Cl.
*A46B 11/00* (2006.01)
*B43K 23/02* (2006.01)

(52) U.S. Cl. ..... 401/129; 401/126; 401/131; 401/48; 401/123; 401/125

(58) Field of Classification Search ..... 401/48, 401/131, 123, 125, 126, 128–130
See application file for complete search history.

(56) References Cited

U.S. PATENT DOCUMENTS

| | | | | |
|---|---|---|---|---|
| 772,382 | A | 10/1904 | Sexton | |
| 1,713,145 | A | 5/1929 | Perry | |
| 2,140,231 | A * | 12/1938 | Jefferis | 215/12.1 |
| 2,141,531 | A | 12/1938 | Graham | |
| 2,562,496 | A | 7/1951 | Kirsch | |
| 2,633,845 | A | 4/1953 | Peretti | |
| 2,659,920 | A * | 11/1953 | Charles et al. | 132/73.5 |
| 2,736,050 | A * | 2/1956 | Lee | 401/122 |
| 3,031,711 | A * | 5/1962 | Herman et al. | 401/27 |
| 3,189,169 | A * | 6/1965 | Davidson | 206/15.2 |
| 4,183,684 | A | 1/1980 | Avery, Jr. | 401/132 |
| 4,779,386 | A | 10/1988 | Harris | 51/205 |
| 5,007,553 | A | 4/1991 | Curtis | 220/90 |
| 6,190,075 | B1 | 2/2001 | Lewis | 401/129 |
| 6,302,608 | B1 | 10/2001 | Holmes et al. | 401/125 |
| 6,435,750 | B1 | 8/2002 | Serna | 401/183 |
| D483,738 | S | 12/2003 | Lovegreen et al. | D14/191 |
| D494,610 | S | 8/2004 | Allen | D16/135 |

FOREIGN PATENT DOCUMENTS

| | | |
|---|---|---|
| WO | WO 01/45533 A2 | 6/2001 |
| WO | WO 02/26081 A1 | 4/2002 |
| WO | WO 03/049571 A1 | 6/2003 |
| WO | WO 03/088802 A1 | 10/2003 |

* cited by examiner

*Primary Examiner*—David J. Walczak
(74) *Attorney, Agent, or Firm*—Alfred M. Walker; Frank Tolin

(57) ABSTRACT

A fluid receptacle which includes a low profile reservoir having a first peripheral surface, a second peripheral surface substantially perpendicular to the first peripheral surface and a third peripheral surface substantially parallel to the first peripheral surface and substantially perpendicular to the second peripheral surface; a handle connected to the first peripheral surface; a stand connected to the second peripheral surface; an applicator handle coupled to the fluid receptacle; and a lid coupled to the fluid receptacle wherein the lid covers an opening to the tire shaped reservoir. In other embodiments, the low profile fluid reservoir has a tire shape. In yet other embodiments, the receptacle uses a reservoir that does not have a tire shape.

13 Claims, 8 Drawing Sheets

FIG. 7
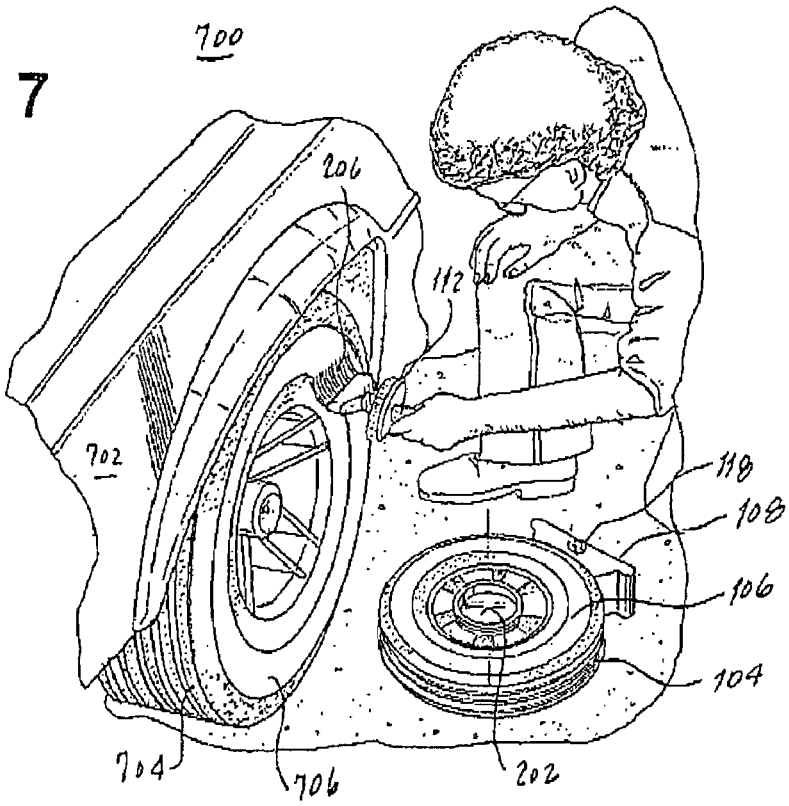
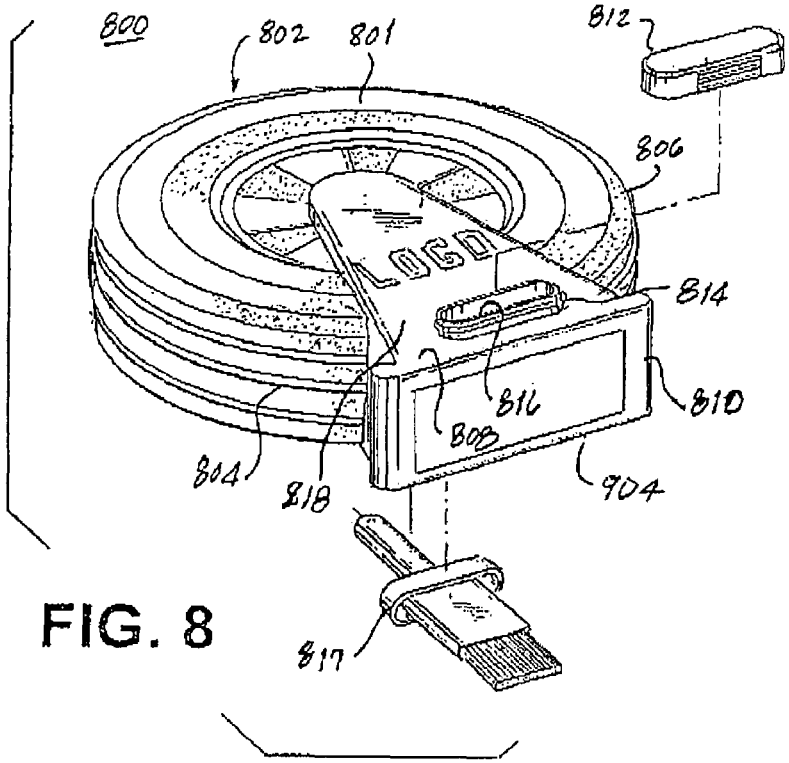
FIG. 8

FIG. 14
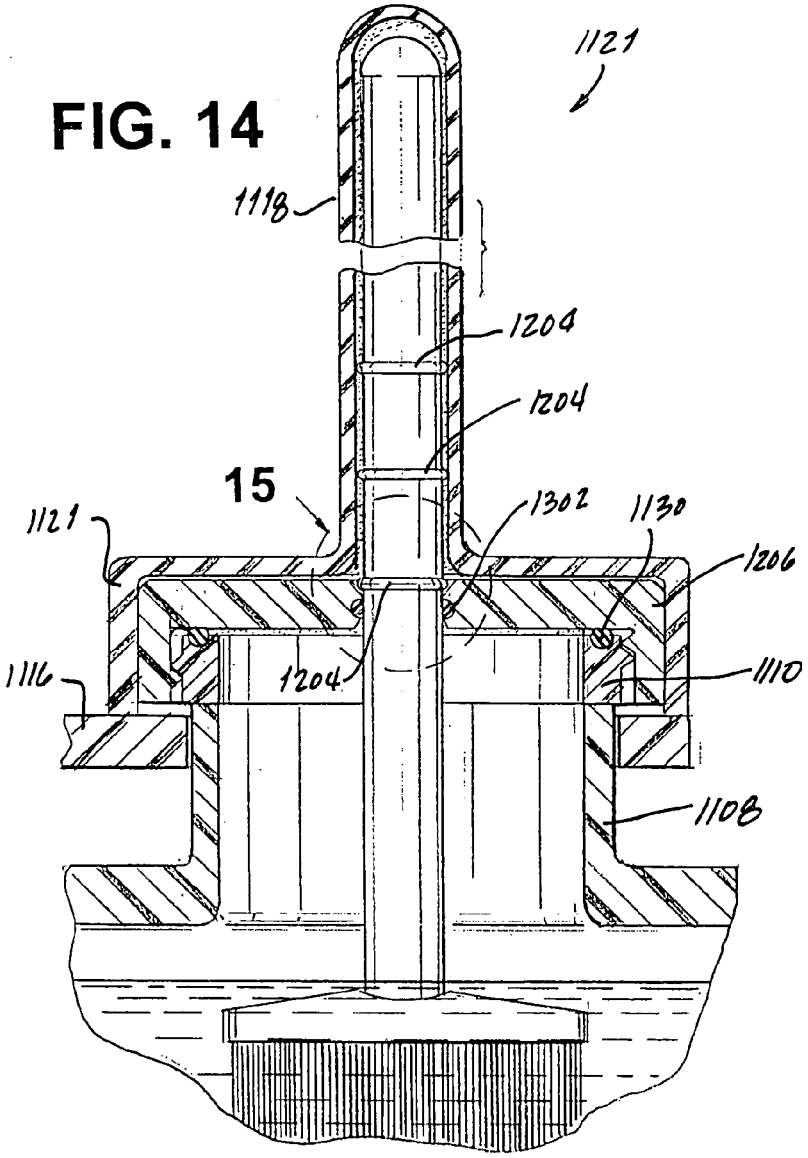
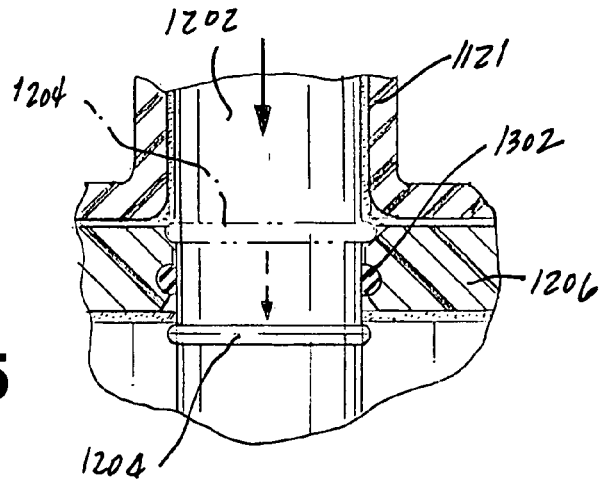
FIG. 15

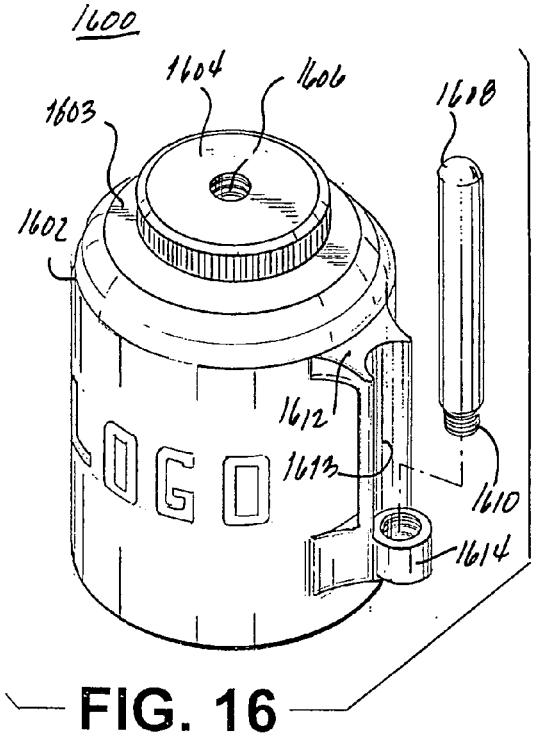
FIG. 16
FIG. 17
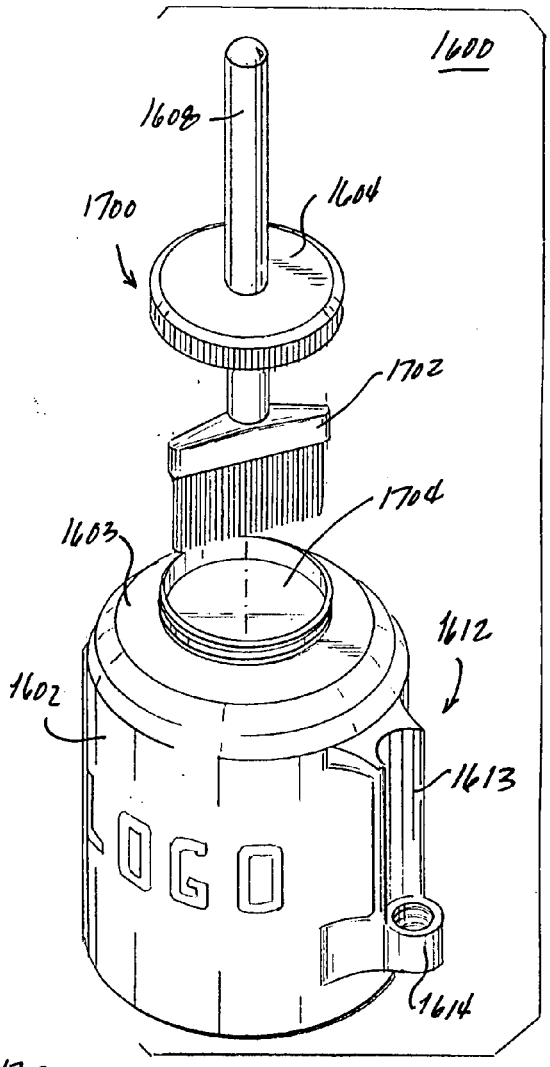
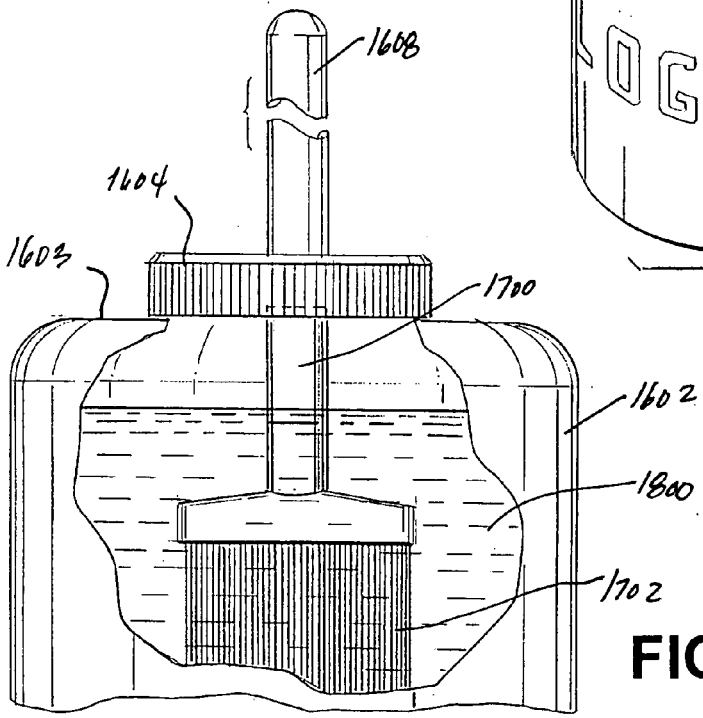
FIG. 18

FLUID CONTAINER WITH INTEGRAL BRUSH

BACKGROUND OF THE INVENTION

1. Field of the Invention

Embodiments of the present invention generally relate to the containment and administration of fluids. More particularly, the invention relates to a container that stores a fluid and an applicator, temporarily located on the container, for the stored fluid.

2. Description of the Related Art

It has been known in the prior art that various liquid products can be packaged and marketed in containers. Similarly, it is known in the prior art, particularly in the prior art pertaining to cleaning products, such as soaps, lotions, etc., that brushes can be provided to be utilized in combination with various types of cleaning products to assist in removing dirt or grime in cooperation with the cleaning fluid, such as soap, etc. These brushes are sold and provided in a wide variety of shapes and sizes. Most of these brushes include structural features mounted on the surface of the body of the brush, such as bristles, to assist in the cleaning operation.

It is known that, particularly where containers contain soaps or other cleaning instruments, it is desirable to provide the brush along with the container of the cleaning material at the point of sale so that the purchaser acquires both the cleaning liquid and the brush to be used with it in one stop. One such brush/container combination where the brush is stored on the container is disclosed in Holmes et al. (U.S. Pat. No. 6,302,608, issued Oct. 16, 2001) ("Holmes"). However, in the Holmes patent, neither the brush nor the container are designed to allow the brush to be inserted within the container and thereby access the fluid within the container.

Most conventional containers used for applying a tire cleaning solution are equipped with a spray dispenser that is troublesome to use. Such a dispenser takes too many pump actions to spray the tire completely and the slightest wind blows the spray on the vehicle and on the person using the dispenser. It is apparent therefore that the best dispenser for a tire cleaning solution would be in the form of a brush with an associated container.

Other brush and container combinations are known in the prior art. For example, Sexton (U.S. Pat. No. 772,382, issued Oct. 18, 1904) describes a brush holder which also functions as a lid for a paint can or other container. Similar brush/container combinations are also shown in Striban (U.S. Pat. No. 1,086,626, issued Feb. 10, 1914), Lonskey (U.S. Pat. No. 1,098,390, issued Jun. 2, 1914), and Woodruff (U.S. Pat. No. 1,455,158, issued Jul. 19, 1921). Although such prior art brush/container combinations are known they suffer from several disadvantages, such as for example difficulty in use.

The present invention is intended to solve the problems inherent in the prior art and provide a unique and advanced brush/container combination where the brush is insertable into the container.

It is therefore one general object of this invention to provide a brush applicator combined with a container of fluid that will provide a quick and easy access by the brush to the fluid (e.g., access to a tire cleaning solution for application by the brush onto a tire).

SUMMARY OF THE INVENTION

The present invention generally to using a container and brush combination where the brush is insertable inside the container and, when not in use, at least a portion of the brush (e.g., a brush handle) is storable on the container. In keeping with these objects and others, which may become apparent, the present invention uses, in one embodiment, a tire shaped reservoir having a first peripheral surface, a second peripheral surface substantially perpendicular to the first peripheral surface and a third peripheral surface substantially parallel to the first peripheral surface and substantially perpendicular to said second peripheral surface; a handle connected to the first peripheral surface; a stand connected to the second peripheral surface; an applicator handle coupled to the fluid container; and a lid coupled to the fluid container wherein the lid covers an opening to the tire shaped reservoir. In various embodiments, the fluid container closely resembles a generally cylindrical automotive tire. Some embodiments of the invention utilize a "low profile" container having a height substantially less than the width diameter of the container. For example, the tire shaped container has a low profile. One advantage of using a low profile container is that the low profile container has a relatively low center of gravity making the container less likely to tip over.

In other embodiments, the invention need not utilize a fluid container resembling an automotive tire. For example, the invention can include a bottom wall; a peripheral side wall connected to the bottom wall; a top wall connected to the peripheral side wall wherein the top wall has an opening; an applicator handle wherein the applicator handle has a distal end; a container handle connected to the peripheral side wall wherein the container handle has a first receptor and is contoured to interlock with the applicator handle; and a lid interlocked with said top wall wherein the lid has a second receptor for receiving the applicator handle.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 7 depicts the embodiment of FIGS. 1-6 in use;

FIG. 8 depicts a perspective view of another embodiment of the invention;

FIG. 14 depicts a close up cross sectional view of the embodiment of the invention depicted in FIGS. 11-13;

FIG. 15 depicts a close up view of aspect 15 depicted in FIG. 14;

FIG. 16 depicts a perspective view yet another embodiment of the invention;

FIG. 17 depicts another perspective view of the embodiment depicted in FIG. 16; and FIG. 18 depicts a close up view of the embodiment depicted in FIGS. 16 and 17.

To facilitate understanding, identical reference numerals have been used, wherever possible, to designate identical elements that are common to the figures.

DETAILED DESCRIPTION OF THE PREFERRED EMBODIMENT

So that the manner in which the above recited features of the invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

Figure 1:
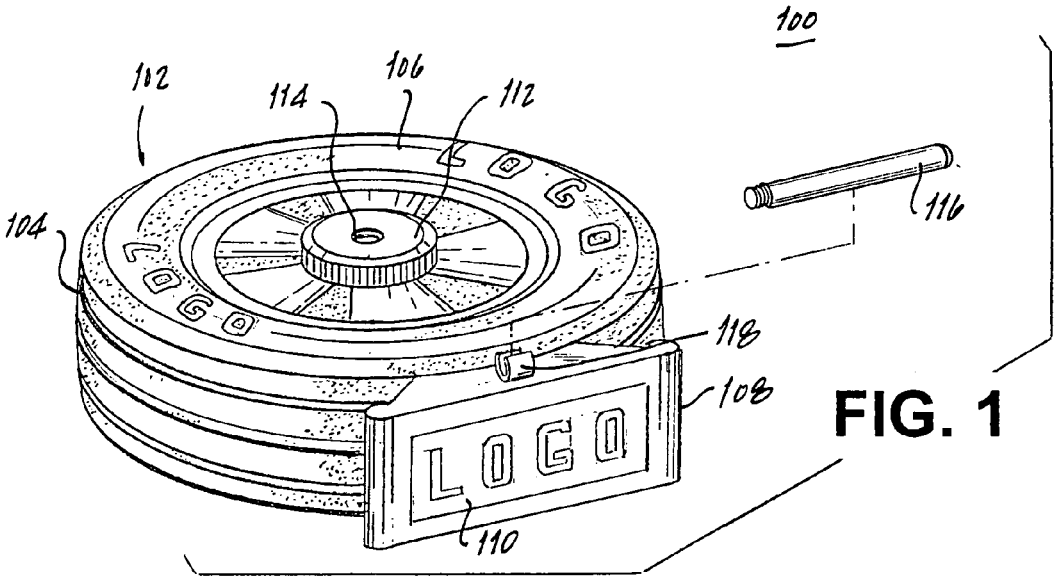
FIG. 1 depicts a perspective view of an embodiment of the invention.

FIG. 1 depicts a perspective view of an embodiment of a fluid container 100 in accordance with the invention. Specifically, FIG. 1 shows the fluid container 100 illustratively in the shape of a tire 102. The container 100 has a height that is substantially less than its diameter width. Thus the fluid container 100 has a low rise (i.e., a low center of gravity). The low rise of the container 100 allows for a relatively greater stability of the container 100 on the ground.

The tire shape 102 of the fluid container 100 has a first side peripheral surface 104 (which appears as the treaded portion of a typical tire), a second upper peripheral surface 106 which is substantially perpendicular to the first peripheral surface 104. Note that there is a third bottom peripheral surface (not shown) substantially perpendicular to the first peripheral surface 104 and substantially parallel to the second peripheral surface 106. The combination of the first peripheral surface 104, second peripheral surface 106, and the third peripheral surface give the fluid container 100 the shape and appearance of a tire.

Located at a substantially central portion of the second peripheral surface 106 is top or lid 112. Removal of the top or lid 112 allows access to an inner chamber (not shown) of the fluid container 100. The top or lid 112 can be temporarily secured to the second peripheral surface 106 of the fluid container 100 in a number of ways in accordance with the invention. Illustratively, the top or lid 112 is temporarily secured to the second peripheral surface 106 via a threaded inner portion on the top or lid 112 which mates with a threaded portion of the second peripheral surface 106.

In addition, the top or lid 112 has a central receptacle 114 for receiving an applicator handle 116. The applicator handle 116 can be temporarily secured to the top or lid 112 via the central receptacle 114 in a number of ways. Illustratively, the applicator handle 116 and the central receptacle 114 have corresponding threads for temporarily securing the applicator handle 116 to the top and lid 112. When not in use, the applicator handle 116 can be secured/stored to the fluid receptacle 100. Illustratively, a clip 118 is affixed to the stand 108 for securing the applicator handle 116 to the fluid receptacle 100. In operation, a user presses the applicator handle 116 into the clip 118. The clip 118 has opposing ends that spread under the pressing force to receive the applicator handle 116. When a user desires to retrieve the applicator handle 116 from the clip 118, the user pulls the applicator handle 116 from the clip 118 forcing the opposing ends of the clip 118 to spread and release the applicator handle 116.

The first peripheral surface 104 has a stand 108 secured to it. The stand 108 has a bottom surface 110. The bottom surface 110 can optionally have a logo or slogan affixed or emblazoned thereon. The stand 108 also operates as a handle, when desired, to hold the fluid container 100.

Figure 2:
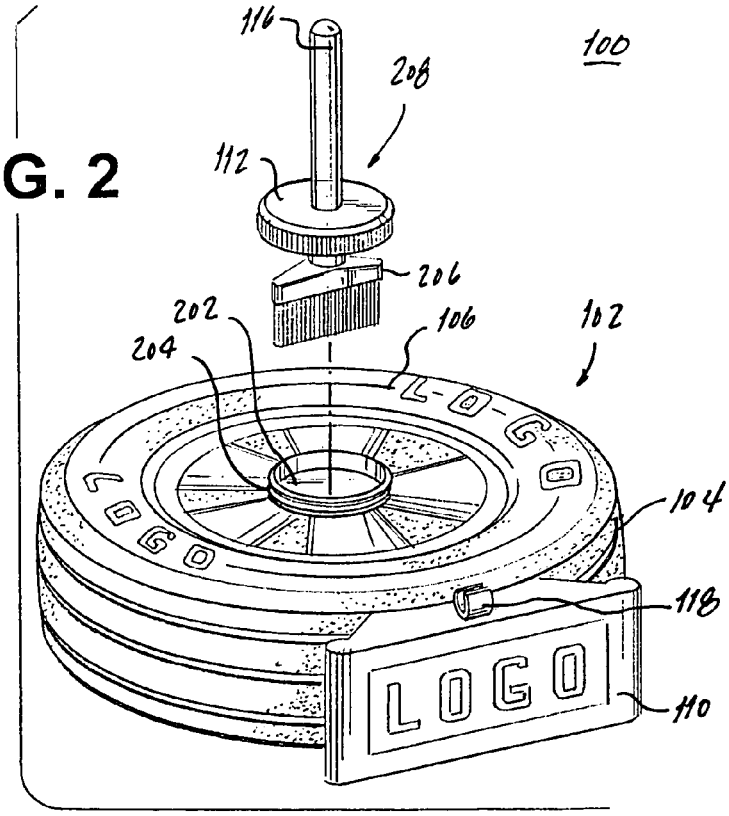
FIG. 2 depicts another perspective view of the embodiment of the invention depicted in FIG. 1.

FIG. 2 depicts another perspective view of the embodiment of the invention depicted in FIG. 1. Various elements depicted in FIG. 2 have already been described with respect to FIG. 1. For brevity, a description of those elements already described with respect to FIG. 1 is not repeated. In addition, to the elements described in FIG. 1, FIG. 2 also depicts the top or lid 112 detached from the second peripheral surface 106 and the applicator handle 116 connected to the top or lid 112. The detached top or lid 112 exposes an opening 202 of the fluid receptacle 100. The opening 202, illustratively, has a threaded periphery 204 which interacts with a correspondingly threaded periphery on the top or lid 112 for temporarily securing the top or lid 112 to the fluid receptacle 100. The top or lid 112 has a brush 206 connected to an opposite side of the top or lid 112. The top or lid 112, brush 206, and applicator handle 116 when coupled together form an applicator 208.

Figure 3:
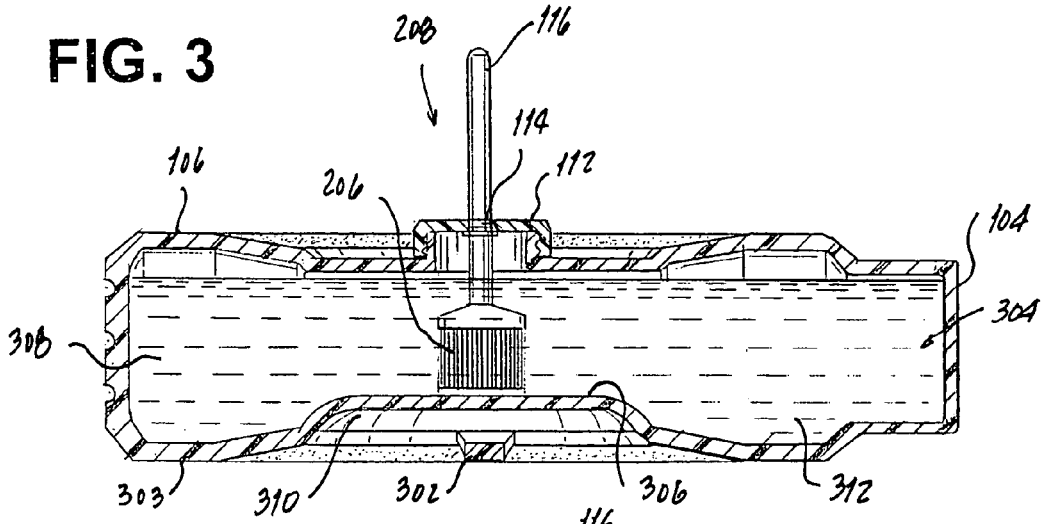
FIG. 3 depicts a cross-sectional view of the embodiment of the invention depicted in FIGS. 1 and 2.

FIG. 3 depicts a cross-sectional view of the embodiment of the invention depicted in FIGS. 1 and 2. Various elements depicted in FIG. 3 have already been described with respect to FIGS. 1 and 2. For brevity, a description of those elements already described is not repeated. In addition to those elements already described above, FIG. 3 also depicts the brush 206 of the applicator 208 inside a cavity 304 of the fluid receptacle 100; a third peripheral surface 303; a handle connected to the third peripheral surface 302; and a well 310 between the handle 302 and the third peripheral surface 303. The well 310 allows a user an unencumbered grip of the handle 302.

The well 310 causes the inner cavity 304 to have a raised inner portion 306 located substantially in the center of inner cavity. The raised inner portion 306 is substantially parallel to the opening 202 and is juxtaposed to the applicator 208. A valley 312 is formed around the raised inner portion 306. As a result of the inner portion 306 being raised with respect to the valley 312, sediment or other contaminants in the fluid 308 trapped within the inner cavity 304 is likely to settle at the valley 312.

Figure 3A:
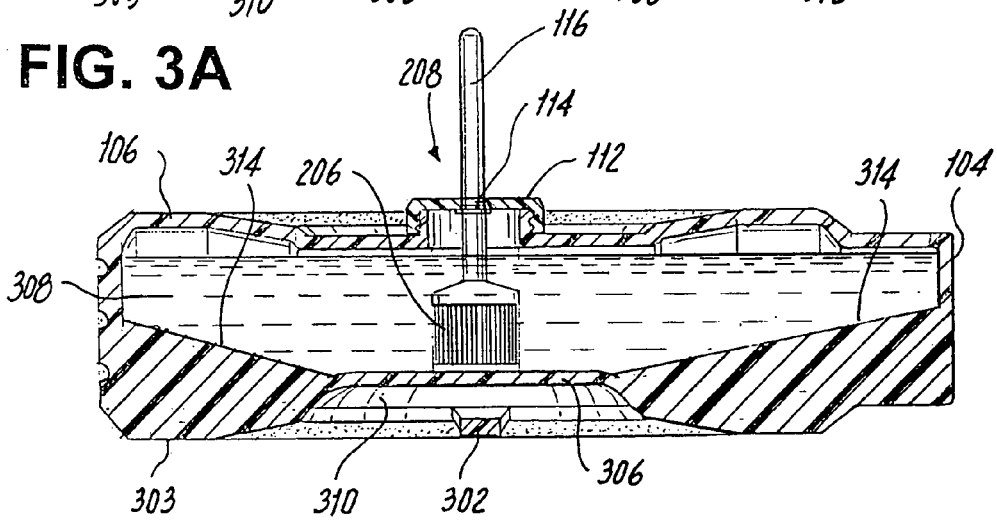
FIG. 3A depicts a cross-sectional view of an alternate embodiment of the inner cavity depicted in FIG. 3.

FIG. 3A depicts a cross-sectional view of an alternate embodiment of the inner cavity depicted in FIG. 3. The embodiment depicted in FIG. 3A is substantially similar to the embodiment depicted in FIG. 3. However, in contrast to FIG. 3, FIG. 3A does not have a valley 312. Instead, contains an angled interior bottom wall 314. The angled interior bottom wall 314 forms an angle with the raised inner portion 306 such that the fluid 308 has a propensity to drain towards the raised inner portion 306. As a result, the user is able to utilize the fluid 308 in the inner cavity 304 when the inner cavity 304 is nearly empty.

Figure 4:
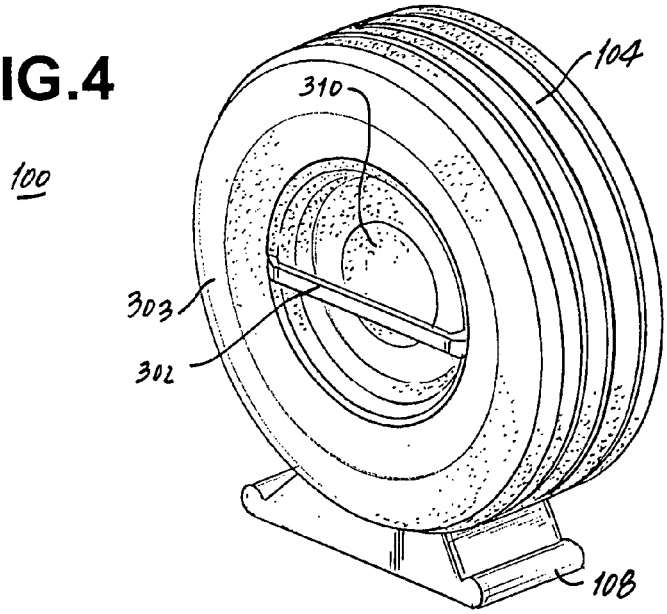
FIGS. 4-6 depict other perspective views of the embodiment of the invention depicted in FIGS. 1-3A.
Figure 5:
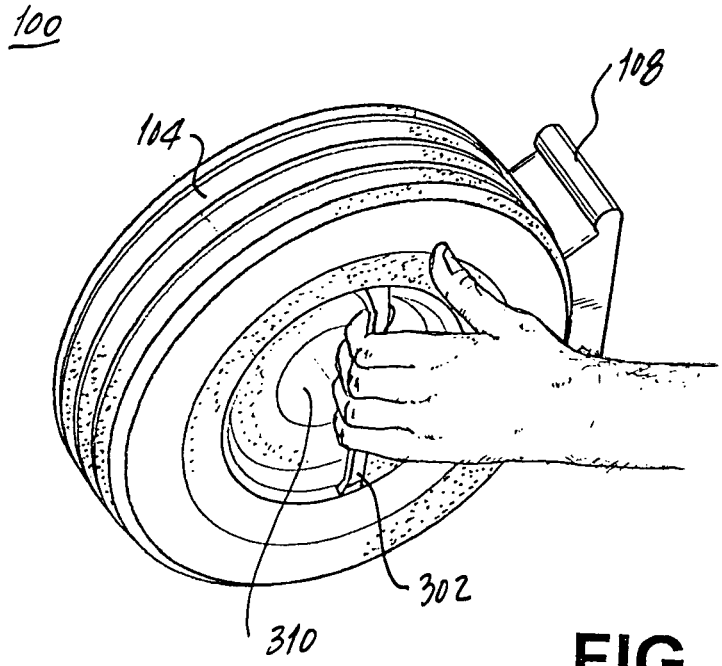
Figure 6:
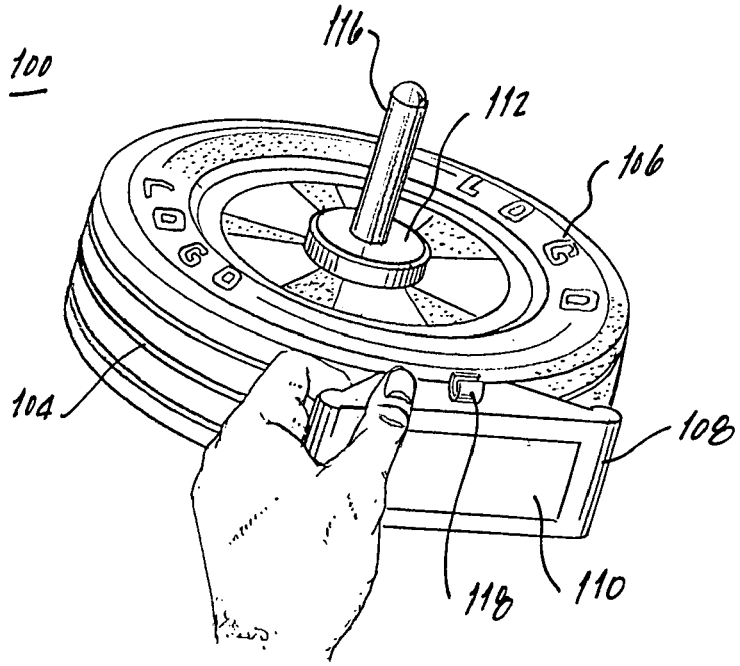

FIGS. 4-6 depict other perspective views of the embodiment of the invention depicted in FIGS. 1-3A. Various elements depicted in FIGS. 4-6 have already been described with respect to FIGS. 1-3A. For brevity, a description of those elements already described is not repeated with respect to FIGS. 4-6.

Referring to FIG. 4, FIG. 4 depicts the fluid receptacle 100 in a vertical position. Specifically, FIG. 4 depicts the fluid receptacle 100 supported by the stand 108. Referring to FIG. 5, FIG. 5 depicts a demonstration of how a user holds the fluid receptacle 100 via handle 302. FIG. 6 demonstrates how the user holds the fluid receptacle 100 using handle 108.

FIG. 7 depicts the embodiment of FIGS. 1-6 in use. Specifically, depicts a partial view 700 of a vehicle 702 and tire 704 being cleaned by a user using the fluid receptacle. Specifically, the user has placed the fluid receptacle on the ground. Thereafter a force is applied to the threaded applicator handle 116 to remove the threaded handle from the holder 118. The user unscrews the top 112 from the second peripheral surface 106. The threaded applicator handle 116 is inserted into the threaded receptacle 114. The combination of the top or lid 112, brush 206, and threaded handle form the applicator 208. To saturate the brush 206 with the fluid (e.g., a tire cleaning solution) in the fluid receptacle 100, the user inserts the applicator 208 into the fluid receptacle via opening 202.

FIG. 8 depicts a perspective view of another embodiment of the invention. Note that the embodiment depicted in FIG. 8 also depicts a low rise container similar to the functioning of the low rise container described above. Specifically, FIG. 8 depicts a fluid receptacle 800 having a tire shaped portion 802 and integrated stand portion 808. Fluid within the fluid receptacle 800 is held within the tire shaped portion 802 and the integrated stand portion 808.

The tire shaped portion 802 has a first peripheral surface 804 and a substantially perpendicular second peripheral surface 806. The first peripheral surface can optionally have a logo or slogan thereon. The first peripheral surface 804 has the appearance of tire treads.

The stand portion 808 has a first side 818, a top or lid 812 temporarily secured to the first side 818, a substantially flat base 810 which is substantially perpendicular to the first side 818, and an opposing second side 904 (described in greater detail below). The substantially flat base 810 is suitable for supporting the fluid receptacle 800.

The top or lid 812 is temporarily secured to the stand portion 808 by applying pressure to the top or lid 812. Specifically, the application of sufficient pressure causes a periphery of the top or lid 812 to expand and interlock with a corresponding mated portion on a lip 814 on the stand portion 808. To remove the top or lid 812, the user pulls the top or lid 812 with a force sufficient to cause the periphery of the top or lid 812 to expand. When the top or lid 812 is removed from the stand portion 808, an opening 816 to an interior portion of the fluid receptacle 800 is exposed. With the opening 816 exposed, the user is able to insert an applicator 817 into the opening 816 of the fluid receptacle 800. When the fluid receptacle 800 is near empty the user can tilt the fluid receptacle 800 on an angle so that the stand portion 808 is lower than the rest of the fluid receptacle 800. This causes the fluid within the fluid receptacle 800 to pool near the opening 816 where the applicator 817 can access the remaining fluid. When the top or lid 812 is secured to the fluid receptacle 800, the user can stand the receptacle 800 upright on the stand portion 808. Because fluid within the receptacle 800 pools toward the flat base 810, the weight of the fluid serves to provide stability to the receptacle 800.

Figure 9:
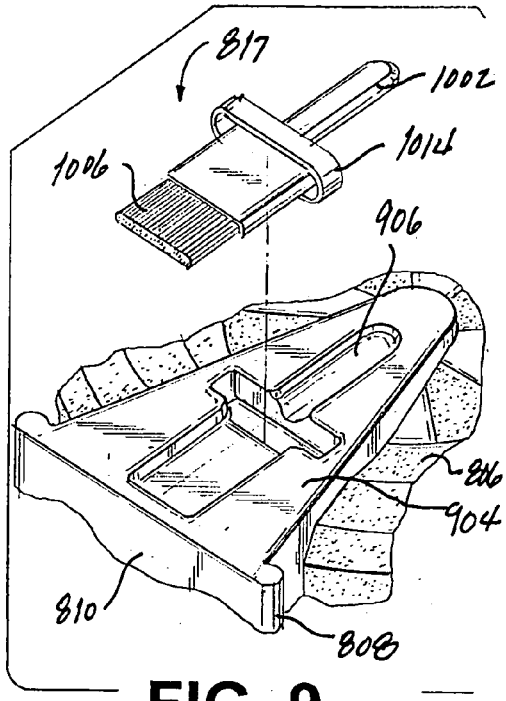
FIG. 9 depicts another perspective view the embodiment of the invention depicted in FIG. 8.

FIG. 9 depicts another perspective view the embodiment of the invention depicted in FIG. 8. Specifically, FIG. 9 depicts a second peripheral surface 902 of the tire shape receptacle 802 and an opposing second side 904 which is connected to and substantially perpendicular with the stand 808.

The opposing second side 904 has a molded recess 906 conforming to the shape of the applicator 817. The molded recess 906 acts as a storage space for the applicator 817. When not in use the applicator 817 is depressed into the molded recess 906. A periphery of the molded recess 906 temporarily secures the applicator 817 to the opposing second side 904. To remove the applicator 817, the user merely inserts at least one finger in a notch (not shown) along the periphery of the molded recess 906 and pulls on the applicator 817 with sufficient force to remove the applicator 817. It is appreciated that the applicator 817, the first side 818, the opposing second side 904, and/or the substantially flat base 810 can have a logo or slogan thereon.

Figure 10:
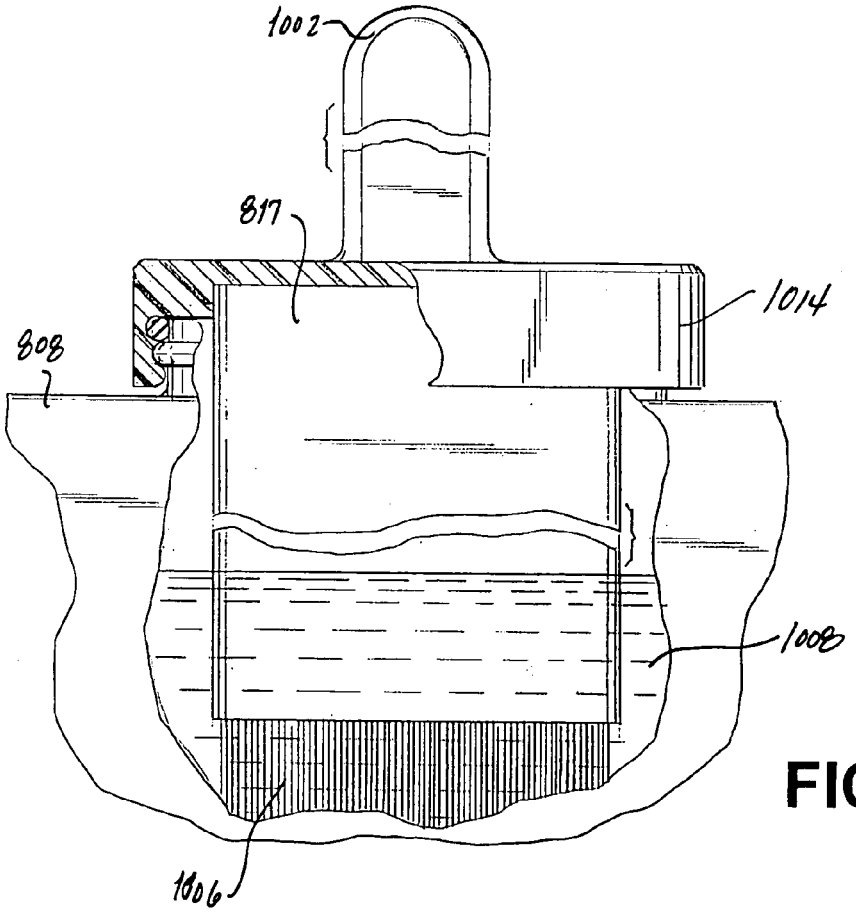
FIG. 10 depicts a close up partial cross-sectional view of the embodiment of the invention depicted in FIG. 9.

FIG. 10 depicts close up partial cross-sectional view of the embodiment of the invention depicted in FIG. 9. Specifically, FIG. 10 depicts the applicator 817 inserted into fluid container 800 via the opening 816.

The applicator 817 includes an applicator handle 1002, a fluid barrier 1014, and a brush 1006. The fluid barrier 1014 is shaped to prevent fluid 1008 from flowing onto the handle 1002 when the brush 1006 is elevated above the handle 1002 (e.g., when a user is using the applicator 816). In addition to preventing the fluid 1008 from flowing on the handle 1002, the fluid barrier 1014 catches the fluid so that the user can reinsert the applicator 817 into the fluid container such that the caught fluid drains from the applicator 817 and intermingles with the fluid 1008 within the fluid container 800.

Figure 11:
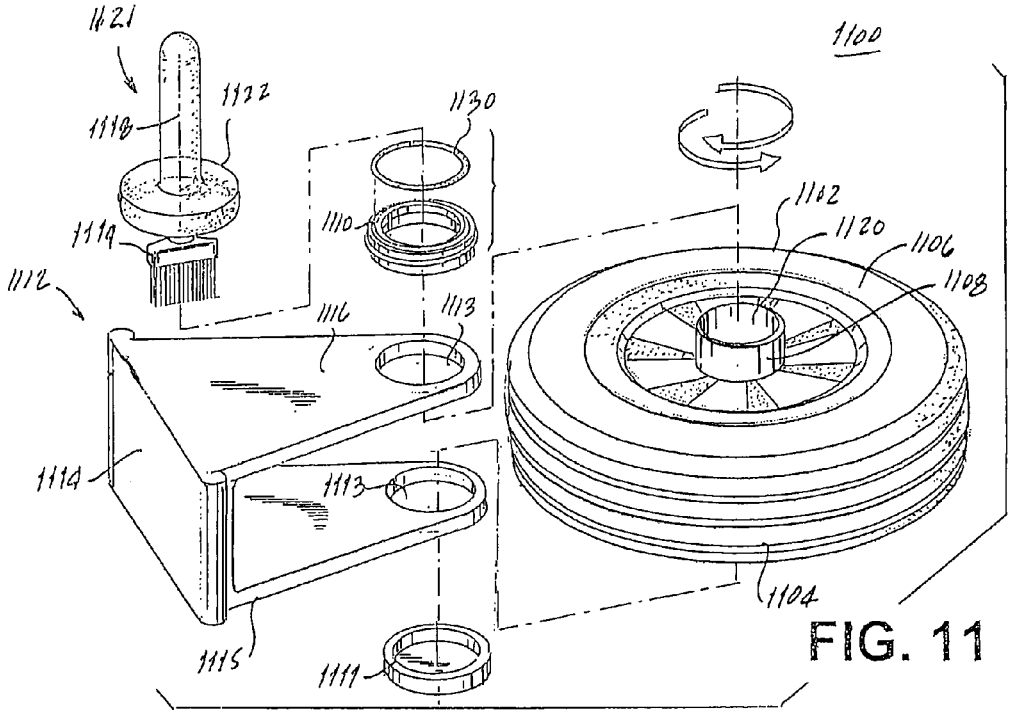
FIG. 11 depicts an exploded perspective view of another embodiment of the invention.

FIG. 11 depicts an exploded perspective view of another embodiment 1100 of the invention. Specifically, FIG. 11 depicts a tire shaped receptacle 1102 which includes a first peripheral surface 1104 (resembling tire treads), a second peripheral surface 1106 substantially perpendicular to the first peripheral surface 1104, a third peripheral surface (not shown) substantially perpendicular to the first peripheral surface 1104 and substantially parallel to the second peripheral surface 1106, and a stand 1112. The second peripheral surface 1106 and the third peripheral surface each have a substantially centrally located threaded hub 1108. The threaded hub 1108 on the second peripheral surface 1106 allows access to an opening 1120 of the fluid container 1100.

The stand 1112 has a substantially flat base 1114 and side panels 1115, 1116 substantially perpendicular to the flat base 1114 and substantially parallel with each other. Each of the side panels 1115, 1116 has an orifice 1113 corresponding to the threaded hub 1108. A user attaches the stand 1112 to the tire shaped receptacle 1102 by inserting the threaded hubs into the orifices 1113.

Thereafter, a threaded annular ring 1110 is screwed onto hub 1108 and a threaded annular ring 1111 is screwed onto the hub located on the third peripheral surface. The threaded annular rings 1110 and 1111 secure the stand 1112 to the tire shaped receptacle 1102. Located within an annular groove of the threaded annular ring 1110 is a first "O" ring 1130. The first "O" ring 1130 acts a seal to help prevent fluid from leaking from the fluid receptacle 1102.

FIG. 11 also depicts a fluid applicator 1121. The fluid applicator 1121 includes a sheath 1118 and an applicator brush 1119. The applicator brush 1119 of the fluid applicator 1121 is insertable within the opening 1120. The length of the applicator brush 1119 can be incrementally adjusted (described in further detail below). The sheath 1118 is made of a pliable material (e.g., rubber). The sheath 1118 has a distal end 1122 that serves to protect the user from any fluid that runs off of the applicator brush 1119 and also interlocks the fluid applicator 1121 with the hub 1108.

Figure 12:
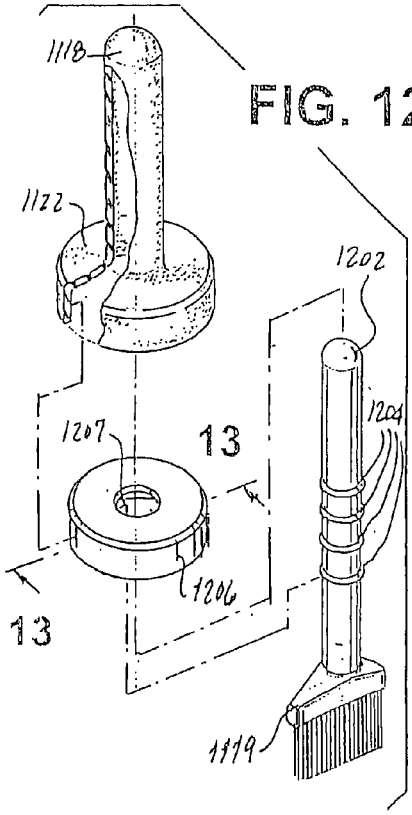
FIG. 12 depicts an exploded perspective view of an embodiment of an applicator depicted in FIG. 11.

FIG. 12 depicts an exploded perspective view of the embodiment of the applicator depicted in FIG. 11. Specifically, FIG. 12 depicts an exploded view of the sheath 1118, a threaded cap 1206, and the applicator brush 1119. The interior of the sheath 1118 is hollow along its longitudinal axis. The threaded cap 1206 has a substantially central hole 1207 therein. The substantially central hole 1207 aligns with the hollow longitudinal axis of the sheath 1118 when the threaded cap 1206 is inserted into the distal end 1122 of the sheath 1118.

The applicator brush 1119 is attached to a shaft 1202. The shaft 1202 has a plurality of ribs 1204 thereon. Once inserted into the sheath 1118 through the threaded cap 1206, the shaft 1202 is held within the sheath 1118 in part by the ribs 1204. A user can adjust the overall length of the applicator brush 1119 by incrementally moving the shaft 1202 within the sheath 1118. The user performs this task by squeezing the distal end of the sheath 1122 and advancing the handle 1202 forward (i.e., forcing the brush 1119 away from the sheath 1122.

Figure 13:
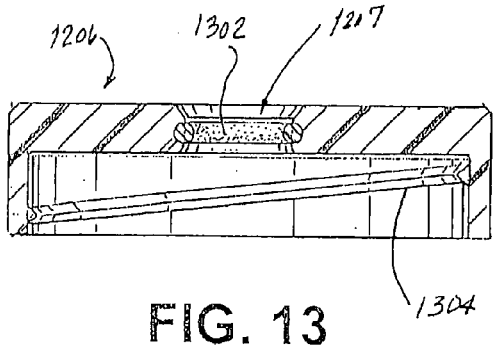
FIG. 13 depicts a cross section view of one aspect of the invention along the 13-13 line.

FIG. 13 depicts a cross-sectional view, along the 13-13 line of FIG. 12, of the threaded cap 1206 and a second "O" ring 1302. In addition, the FIG. 13 also depicts a threaded portion 1304. The user inserts the shaft 1202 into the threaded cap 1206. The second "O" ring 1302 allows the shaft 1202 to pass there-through. When shaft is advanced such that the ribs 1204 come into contact with the second "O" ring 1302, the user applies sufficient force to cause ribs to expand and allow the progression of the shaft 1202 within the sheath 1122.

FIG. 14 depicts a close up cross sectional view of the embodiment of the invention depicted in FIGS. 11-13. Specifically, FIG. 14 depicts the applicator brush 1119 inside of the fluid receptacle 1102 and the sheath 1118 contacting the side panel 1116. Various elements depicted in FIG. 14 have already been described with respect to FIGS. 11, 12, and 13. For brevity, a description of those elements already described with respect to FIGS. 11, 12, and 13 is not repeated in as much detail.

Briefly, side panel 1116 is coupled to the threaded hub 1108. The annular ring 1110 is interconnected with the threaded hub 1108. The annular ring 1110 has the first "O" ring partially disposed therein. The threaded cap 1206 is secured to the distal end 1122 of the sheath 1121. The threaded cap 1206 has a second "O" ring 1302 disposed therein. The handle 1202 is disposed within the sheath 1121 and temporarily held within the sheath 1121 by the second "O" ring 1302. As fluid within the fluid receptacle 1102 diminishes, less of the applicator brush 1119 is immersed within the fluid. To increase the amount of the applicator brush 1119 immersed within the fluid, the user can advance the applicator brush 1119 (i.e., force the applicator brush 1119 away from the distal end 1122). To advance the applicator brush 1119, the user squeezes a portion of the sheath 1121 not juxtaposed with the handle 1202. Sufficient squeezing force causes rib(s) 1204 to advance beyond the second "O" ring 1302. As a result, the applicator brush 1119 is deeper within the fluid receptacle 1102.

FIG. 15 depicts a close up view of the encircled area 15 depicted in FIG. 14. FIG. 15 depicts the motion of the handle 1202 when the user has applied a squeezing force to the sheath 1121 to advance the applicator brush 1119. The squeezing force and advancing motion depress the second "O" ring 1302 to allow the rib(s) to bypass the second "O" ring 1302. All of the elements depicted in FIG. 15 have already been described with respect to FIGS. 12 and 13. For brevity, a description of those elements is not repeated.

FIG. 16 depicts a perspective view yet another embodiment of the invention. Specifically, FIG. 16 depicts a fluid container 1600 that includes a side peripheral surface 1602, a bottom peripheral surface (not shown), and a top peripheral surface 1603.

A top or lid 1604 is temporarily interlocked with the top peripheral surface 1603. In one embodiment, the top or lid 1604 and the top peripheral surface 1603 have corresponding threads for screwing (and temporarily interlocking) the top or lid 1604 onto the top peripheral surface 1603. The top or lid 1604 has a substantially centrally located first receptor 1606.

The side peripheral surface 1602 has attached thereto a container handle 1612 having a longitudinal axis substantially perpendicular to the bottom peripheral surface. The container handle 1612 has a distal end, a proximal end, and a groove 1613 that runs along the longitudinal axis. A second receptor is located at the distal end of the container handle 1612.

FIG. 16 also depicts an applicator handle 1608. The applicator handle 1608 has a proximal end and a distal end 1610. The distal end 1610 corresponds to the first receptor 1606 and the second receptor 1614. In addition, the groove 1613 corresponds to the periphery of the applicator handle 1608. As such, a user inserts the applicator handle 1608 into the first receptor 1606, when the user wishes to use the fluid container 1600. Otherwise, the user can store the applicator handle 1608 against the container handle 1612 by inserting and interlocking the distal end 1610 of the applicator handle 1608 into the second receptor 1614. In various embodiments, the distal end 1610 has threads corresponding with threads located within the first receptor 1606 and the second receptor 1614 respectively to allow temporary interlocking of the applicator handle 1608.

FIG. 17 depicts another perspective view of the embodiment depicted in FIG. 16. Specifically, FIG. 17 depicts a fluid applicator 1700 outside of the fluid container 1600. The fluid applicator includes the top or lid 1604, the distal end 1610 of the applicator handle 1608 inserted within the first receptor 1606, and an applicator brush 1702 connected to an underside of the top or lid 1604. The removal of the top or lid 1604 from the top periphery 1603 exposes an access 1704 to fluid located within the fluid container 1600. Other elements depicted in FIG. 17 have been shown and described with respect to FIG. 16. For brevity, further discussion of those previously described elements is not repeated.

FIG. 18 depicts a close up view of the embodiment depicted in FIGS. 16 and 17. Specifically, FIG. 18 depicts the applicator 1700 inside the fluid container 1600. For clarity, a portion of the first peripheral surface 1602 is invisible to show the applicator brush 1702 immersed in fluid 1800 within the fluid container 1601.

In the foregoing description, certain terms and visual depictions are used to illustrate various embodiments of the invention. However, no unnecessary limitations are to be construed by the terms used or illustrations depicted, beyond what is shown in the prior art, since the terms and illustrations are exemplary only, and are not meant to limit the scope of the present invention. For example, it is appreciated that various portions of the fluid container can have a slogan and/or a logo thereon (e.g., the top or lid, stand, any peripheral surface, and/or the applicator handle). In addition, it is appreciated that the invention can be used to house and administer various types of fluids (e.g., a tire cleaning solution or tire dressing solution). Further, although the low rise container has been depicted and described and being in the shape of a tire, it is appreciated that the container can be in any shape in which the height of the container is less than the diameter width of the container. Thus, while the foregoing is directed to embodiments of the present invention, other and further embodiments of the invention may be devised without departing from the basic scope thereof, and the scope thereof is determined by the claims that follow.

I claim:

1. A fluid receptacle comprising:

a low profile reservoir having an upper horizontal surface, a bottom surface parallel to said upper surface, and a side peripheral surface substantially perpendicular to said upper and bottom surfaces, said surfaces formed into a shape of a tire with said side peripheral surface having the appearance of tread on a tire;

a central opening into said upper horizontal surface having a removable, flat lid covering said central opening;

a stand connected to and extending from said side peripheral surface to allow said receptacle to stand in an upright position with the upper and bottom surfaces extending in a vertical direction, said reservoir resting on said bottom surface when access is made to an interior of said receptacle through said central opening, and said reservoir having a relatively low center of gravity when resting on said bottom surface for greater stability of said receptacle on the ground;

a removable applicator handle coupled to an upper side of said lid and a brush connected to an underside of said lid extending into said fluid receptacle.

2. The receptacle according to claim 1 wherein said bottom surface has a central, inverted, external well forming a raised plateau within the interior of said reservoir, said plateau surrounded by an annular valley for settling of sediments and other contaminants.

3. The receptacle according to claim 2 wherein said inverted well has a handle member spanning said well.

4. The receptacle according to claim 3 wherein said stand comprises a flat surface perpendicular to said upper and bottom surfaces adjacent said side peripheral surface, said receptacle resting on said flat surface when acting as a stand for said receptacle.

5. The receptacle according to claim 3 wherein said stand has a clip for coupling said applicator handle to said fluid receptacle after removal from said lid.

6. The receptacle according to claim 5 wherein said applicator handle and lid have corresponding threads for coupling said applicator handle to said lid.

7. The receptacle according to claim 6 wherein a portion of said stand has a stand handle.

8. The receptacle according to claim 7 further comprising at least one of a logo and a slogan on a surface of said stand visible when said receptacle is resting on said bottom surface.

9. The receptacle according to claim 8 wherein said brush is directly above said plateau when said lid is in place covering said central opening.

10. The receptacle according to claim 1 further comprising:

an angled interior bottom surface with a lowest point directly below said brush so that fluid within the reservoir drains toward said lowest point.

11. The receptacle according to claim 1 wherein said stand is hollow and allows access to fluid within said tire shaped reservoir.

12. The receptacle according to claim 1 further comprising a sheath being hollow along its longitudinal axis, said sheath enclosing said applicator handle therein, said sheath removably connected to said receptacle, said sheath being made of a pliable material permitting user application of pushing force against said applicator brush, said sheath having a closed distal end serving to protect the user from any fluid that runs off of said applicator brush, said lid of said receptacle having a substantially central hole therein, said substantially central hole in alignment with said hollow longitudinal axis of said sheath.

13. The receptacle according to claim 12 wherein a user can adjust the overall length of the applicator brush by incrementally moving said handle within said sheath by squeezing said distal end of said sheath and advancing said handle further into said receptacle.

* * * * *